US011578730B2

(12) United States Patent
Barron et al.

(10) Patent No.: US 11,578,730 B2
(45) Date of Patent: Feb. 14, 2023

(54) COOLING FAN AND NOISE GENERATION APPARATUS

(71) Applicant: Lasko Operation Holdings LLC, Wilmington, DE (US)

(72) Inventors: Heather Barron, Malvern, PA (US); Neal Franciotti, Doylestown, PA (US); Thomas Hebling, Oreland, PA (US); Sean Haney, Pottstown, PA (US)

(73) Assignee: Lasko Operation Holdings LLC, Wilmington, DE (US)

( * ) Notice: Subject to any disclaimer, the term of this patent is extended or adjusted under 35 U.S.C. 154(b) by 28 days.

(21) Appl. No.: 17/323,203

(22) Filed: May 18, 2021

(65) Prior Publication Data

US 2021/0364012 A1 Nov. 25, 2021

Related U.S. Application Data

(60) Provisional application No. 63/028,060, filed on May 21, 2020.

(51) Int. Cl.

| | |
|---|---|
| ***F04D 29/42*** | (2006.01) |
| ***F04D 25/08*** | (2006.01) |
| ***G10K 15/04*** | (2006.01) |
| ***F04D 29/30*** | (2006.01) |
| ***F04D 29/66*** | (2006.01) |

(52) U.S. Cl.

CPC ..... *F04D 29/4226* (2013.01); *F04D 25/08* (2013.01); *F04D 29/30* (2013.01); *F04D 29/663* (2013.01); *G10K 15/04* (2013.01)

(58) Field of Classification Search

CPC ..... F04D 29/4226; F04D 25/08; F04D 29/30; F04D 29/663; G10K 15/04

USPC ..... 417/423.1

See application file for complete search history.

(56) References Cited

U.S. PATENT DOCUMENTS

| | | | | |
|---|---|---|---|---|
| 3,094,872 A | | 6/1963 | Leavenworth | |
| 3,094,972 A | * | 6/1963 | Leavenworth | G10K 7/00 600/28 |
| 3,121,220 A | * | 2/1964 | Buckwalter | A61M 21/00 340/404.2 |
| 3,826,333 A | * | 7/1974 | Buckwaiter | G10K 13/00 181/155 |
| 4,138,673 A | * | 2/1979 | Faust | G10K 7/04 340/404.2 |
| 5,816,910 A | | 10/1998 | Steele et al. | |
| 9,854,352 B2 | | 12/2017 | Huang | |
| 10,510,335 B2 | * | 12/2019 | Lazar | G06F 3/165 |

(Continued)

*Primary Examiner* — Hung Q Nguyen
*Assistant Examiner* — Anthony Donald Taylor, Jr.
(74) *Attorney, Agent, or Firm* — Lawrence J. Shurupoff

(57) ABSTRACT

Airflow from a blower fan can be adjusted between a cooling air mode where cooling air flows freely to the ambient surroundings and a noise mode where the airflow is partially or fully restricted in order to produce different levels of soothing background noise. The airflow from the fan can be split or divided between varying degrees and combinations of unrestricted airflow, partially restricted airflow and fully restricted airflow to produce a wide range of cooling airflows into the ambient with or without the production of additional background noise. A perforated drum surrounds the fan to form a chamber within which airflow can resonate at various frequencies and amplify noise levels selected by rotating the drum around the fan.

23 Claims, 8 Drawing Sheets

(56) References Cited

U.S. PATENT DOCUMENTS

| | | | | |
|---|---|---|---|---|
| 10,720,143 | B2 | 7/2020 | Dennis et al. | |
| 2015/0104159 | A1* | 4/2015 | Tyburk | H05B 1/0269 392/364 |
| 2019/0172439 | A1* | 6/2019 | Dennis | G10K 15/04 |
| 2019/0316602 | A1* | 10/2019 | Singleton | F04D 29/282 |

* cited by examiner

COOLING FAN AND NOISE GENERATION APPARATUS

RELATED APPLICATION DATA

This application claims priority to U.S. provisional patent application Ser. No. 63/028,060 filed May 21, 2020, which patent application is hereby incorporated by reference in its entirety.

FIELD OF THE DISCLOSURE

The present disclosure relates in general to methods and apparatus for selectively providing cooling and refreshing airflow from a fan and for adjusting the airflow to produce pleasing and soothing background noise, such as white noise, as well as combinations of airflow and noise.

BACKGROUND AND SUMMARY

A compact fan-driven airflow system has been developed that produces and directs airflow through various user-selectable flowpaths to provide cooling airflow to the ambient surroundings and to produce background noise at various frequencies, intensities and energy levels. The airflow produced by a variable speed fan is directed through selected degrees of flow restriction to generate free airflow to ambient or to resonate within a substantially restricted acoustic chamber.

Some restricted airpaths produce a broadband noise of varying noise shape and intensity. Background noise is produced under restricted airflow conditions. As the degree of airflow restriction is adjusted by a user, the frequency spectrum of the noise produced by the system varies to suit the user's cooling needs and background noise preferences.

The volume of the noise produced by the airflow can be increased or decreased by varying the speed of the motor driving the fan. For example, an AC motor with preset selectable speeds or a DC motor with user-controlled variable speeds can be used to vary the sound level produced by the fan.

In one embodiment, a fan is fixed in position on a base and surrounded by a fan housing fixed on the base. The fan housing has an exhaust port which directs airflow radially outwardly towards an outer housing. The outer housing is also fixed in position on the base and has an air exit opening axially and radially aligned with the exhaust port on the fan housing.

A movable drum, such as a rotatable drum is mounted on the base between the fixed fan housing and the fixed outer housing. Circumferentially-spaced noise-producing holes of varying shapes and sizes are formed through the drum. As the drum is rotated relative to the fan housing and the outer housing, different holes in the drum are positioned in front of the exhaust port on the fan housing. As the airflow from the fan flows through the different holes, it produces different types of background noise.

BRIEF DESCRIPTION OF THE DRAWINGS

In the drawings.

In the various views of the drawings, like reference numbers designate like or similar parts.

DESCRIPTION OF REPRESENTATIVE EMBODIMENTS

Figure 1:
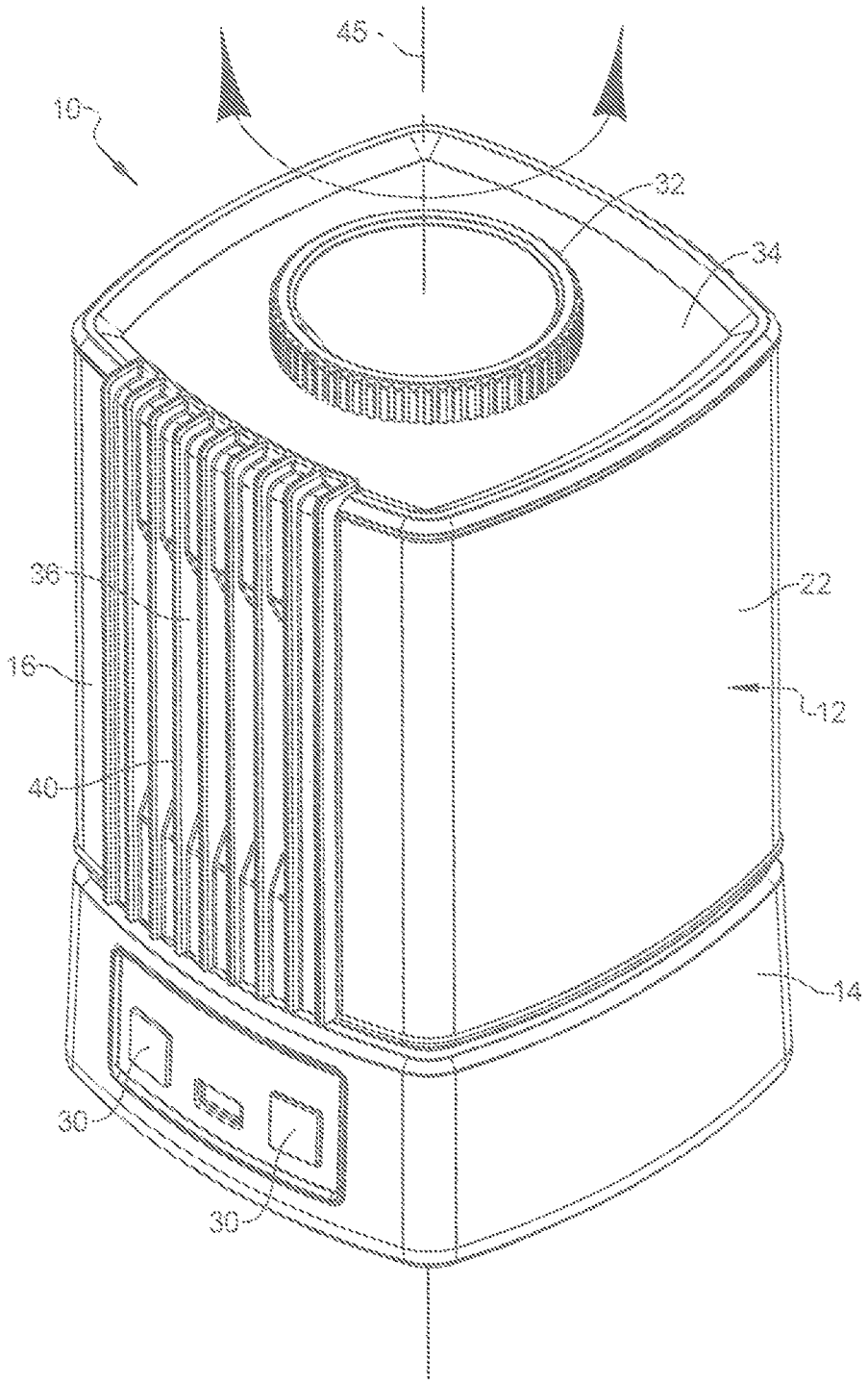
FIG. 1 is a front right side perspective view of a representative embodiment of a combination fan and noise generation apparatus constructed in accordance with this disclosure.

An example of the construction and operation of a compact multifunction cooling fan and noise generation system 10 is shown in FIGS. 1-7. Beginning with FIGS. 1 and 2, the system 10 includes an outer housing 12 supported on a base 14. The outer housing 12 includes a front housing portion 16, a back housing portion 18 and a pair of housing sidewalls 22, 24.

In one embodiment, the footprint of the base 14 can be as compact as about five inches by five inches with the outer housing having a height from its top to the bottom of the base of about eight and one half inches. Of course, other sizes and shapes are possible.

User controls 30 are provided on the front of the base 14 for controlling a fan located within the outer housing 12. The fan is described in more detail below. The controls 30 can turn the fan on and off and can select the operating speeds of the fan. Control circuitry 31 (FIG. 4) provides selectable speed control in a known fashion.

In one embodiment, the system 10 can be provided with a conventional fan oscillation function selectable with one of the user controls 30. The mechanical operation of the system 10 can be further controlled by rotating knob 32, as described below.

The knob 32 is provided on the exterior of the outer housing 12, such as on the top portion 34 of the outer housing 12. Knob 32 can be rotated for adjusting and selecting various air flowpaths and various degrees of airflow restriction through the system 10.

Figure 3B:
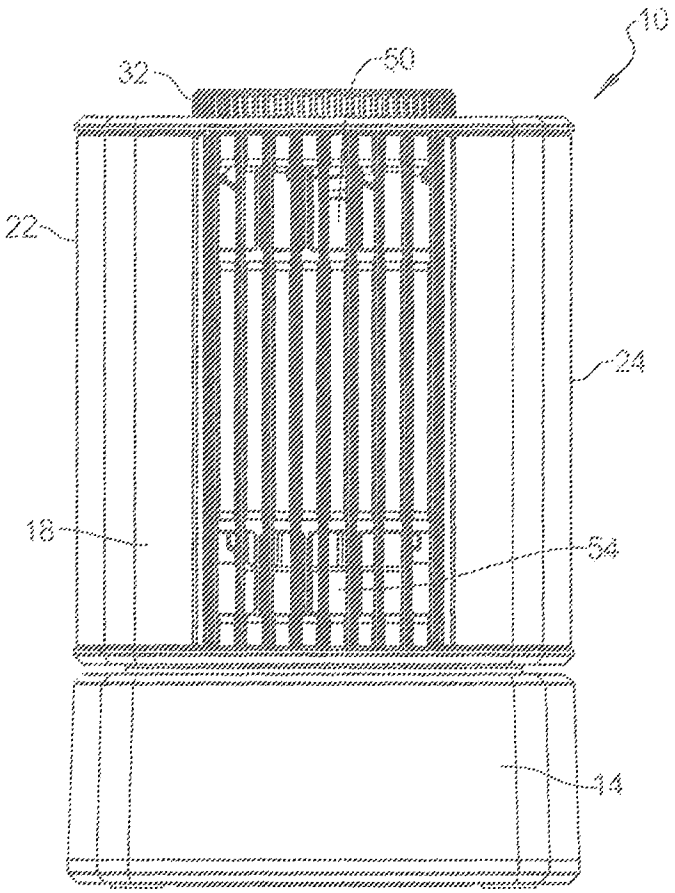
FIG. 3*b* is a rear elevation view of the apparatus of FIG. 1.
Figure 3A:
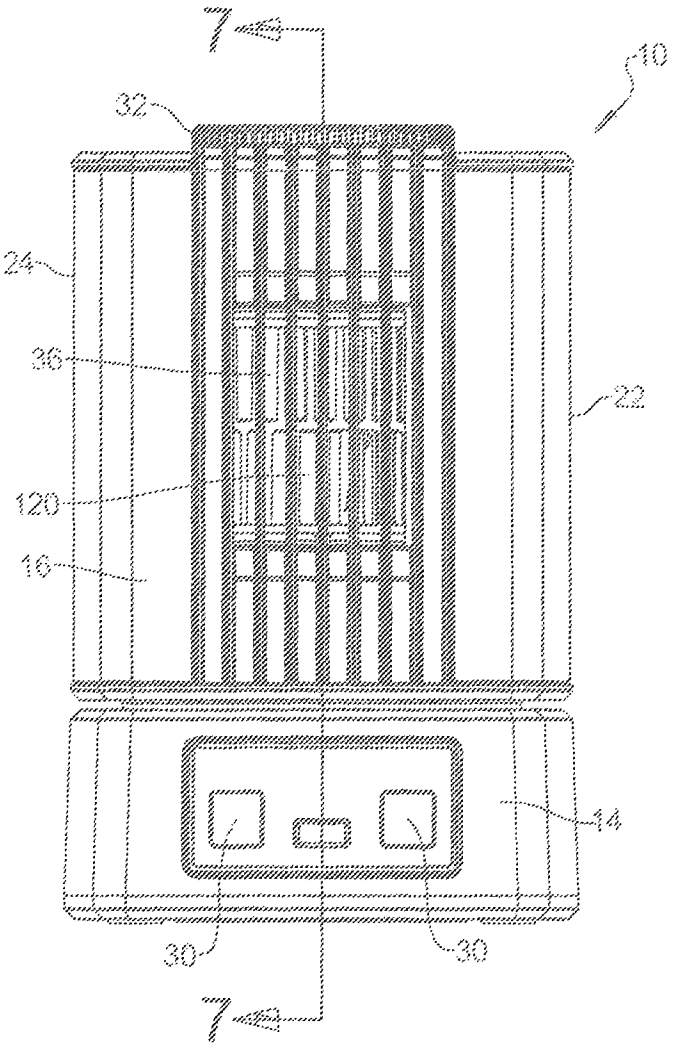
FIG. 3*a* is a front elevation view of the apparatus of FIG. 1.

FIGS. 1 and 3*a* show the front housing portion 16 provided with a rectangular front air exit opening 36 partially covered by a front grille 40. In FIG. 3*a*, the front air exit opening 36 is shown in an unblocked or fully open position for minimizing the resistance of airflow from within the outer housing 12 to the ambient.

Figure 7:
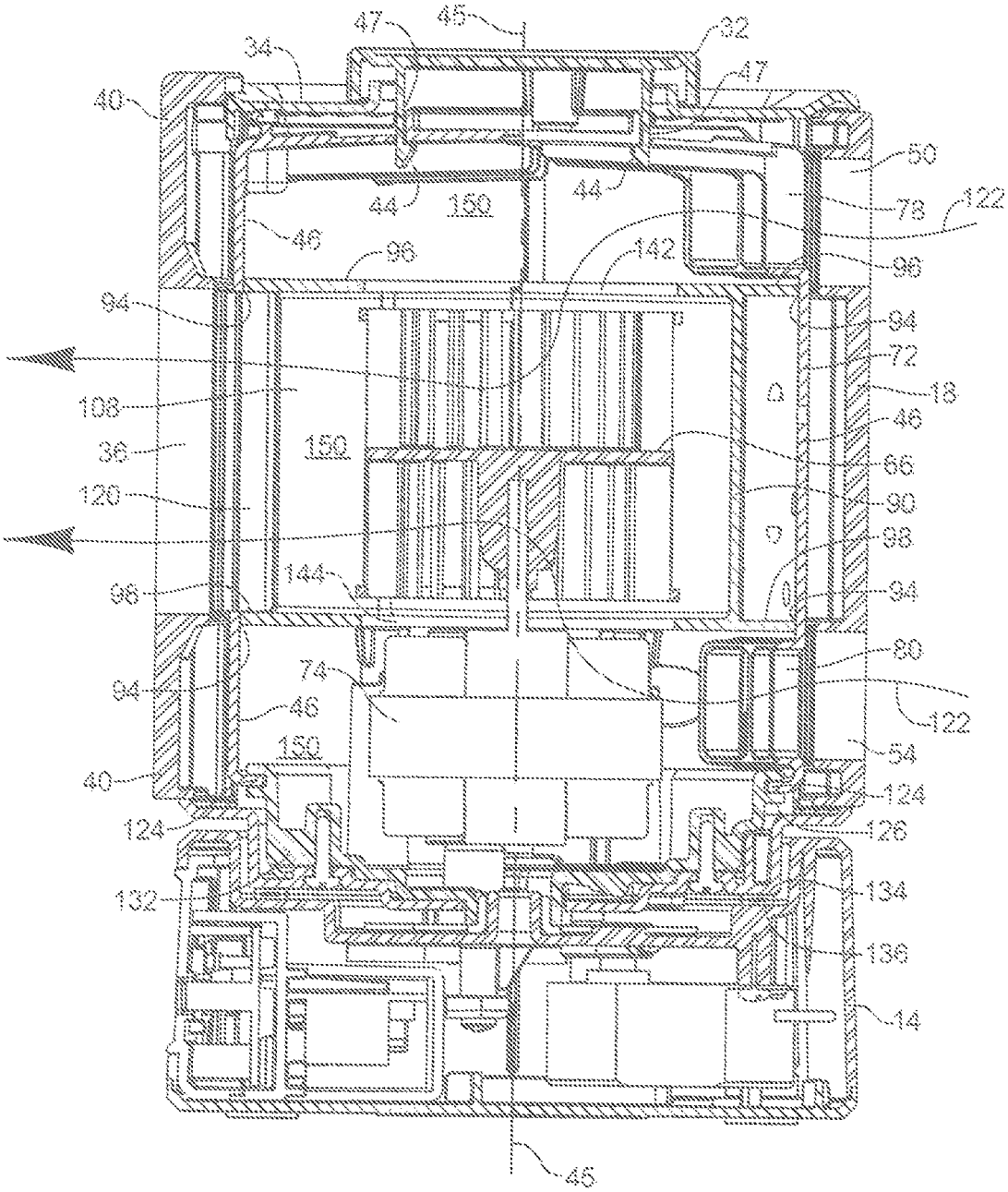
FIG. 7 is a view in section taken along section line 7-7 of FIG. 3*a*.

Airflow through the front air exit opening 36 can be gradually obstructed from an unblocked position as shown in FIGS. 3*a* and 7, to a partially blocked, substantially blocked or virtually fully blocked position which substantially restricts or blocks airflow from exiting the outer housing 16. That is, by rotating the knob 32, a user can selectively provide full airflow to ambient or gradually restrict or block airflow from exiting the outer housing 12 through the front air exit opening 36.

FIG. 3*b* shows the back housing portion 18 positioned in the same operating configuration as shown in FIGS. 1 and 3*a*. In this position, resistance to airflow into, through and out of the outer housing 12 is minimized.

Figure 4:
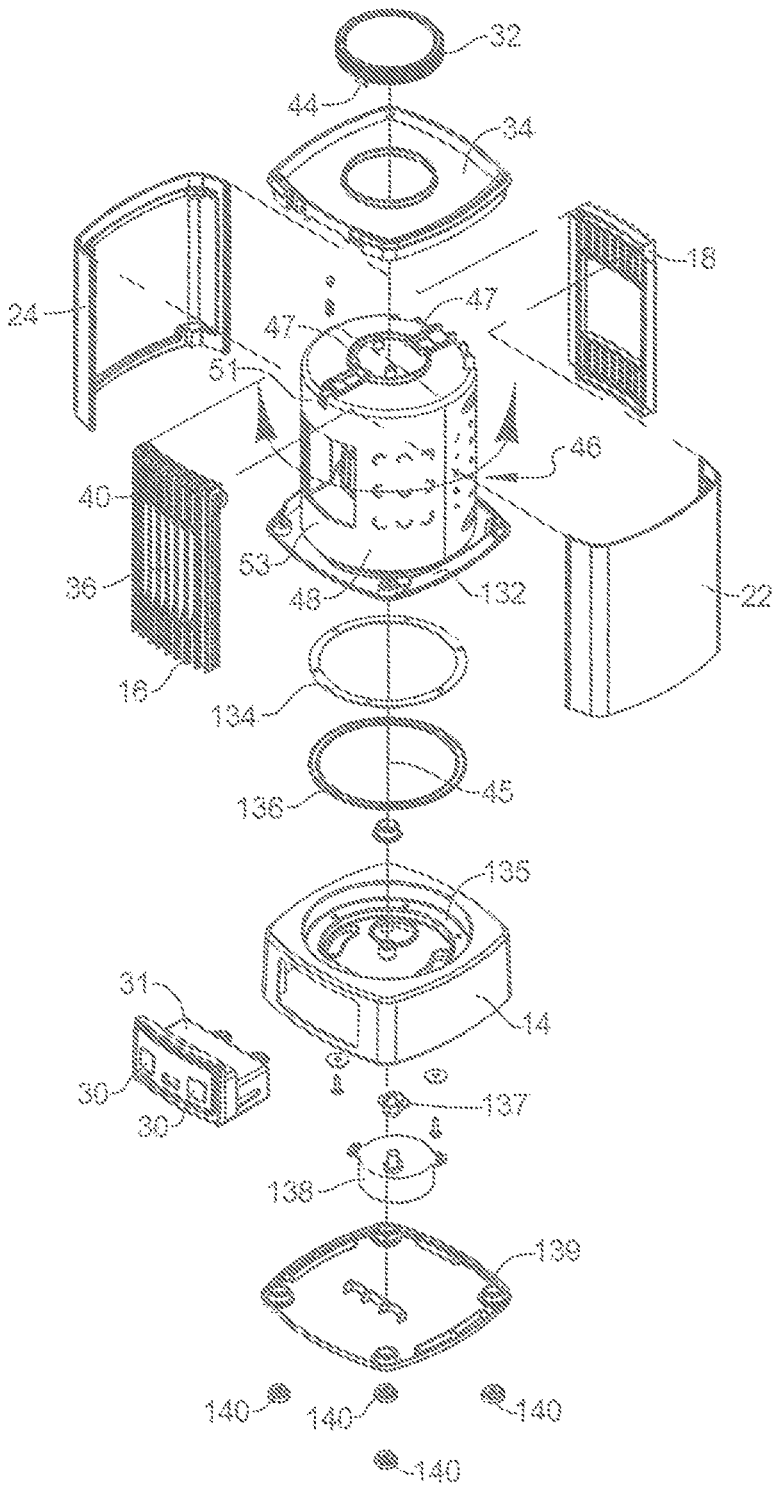
FIG. 4 is an exploded top perspective view of the apparatus of FIG. 1.

As shown in FIG. 4, a bidirectional movable drum 46 with cylindrical sidewalls 48 is selectively driven and adjustably rotated by turning the knob 32 around a central axis 45. As used herein, the terms axial, radial and circumferential are referenced to the central axis 45. Tabs 44 (FIG. 7) on the knob 32 extend through the top portion 34 of the outer housing 12 and are secured within pockets 47 in the top of the drum 46.

The rotatable drum 46 is provided within the outer housing 12 for controlling the amount of airflow exiting through the front air exit opening 36 and may also control the amount of airflow entering within the outer housing 12. The drum 46 further functions as an enclosure or acoustic chamber which assists in the resonance and amplification of noise within the drum and outer housing 12.

In FIG. 4, the drum 46 is positioned to allow for the substantially free unrestricted exit of airflow from within the outer housing 12 into the ambient. When the drum 46 is rotated 180 degrees to the left or right from its position in FIG. 4, the drum 46 is positioned to substantially restrict or block airflow from directly entering into the outer housing 12 and from directly exiting from within the outer housing 12 to the ambient.

In FIGS. 1-7, the system 10 and its respective parts are positioned and arranged so that little to no portion of the drum 46 blocks air from directly exiting the fixed front air exit opening 36. As the drum 46 is rotated from its position shown in FIG. 5, different solid and perforated portions of the drum 46 are aligned and registered with the front air exit opening 36 to restrict or substantially or fully block airflow from directly exiting through the front air exit opening 36.

Figure 2:
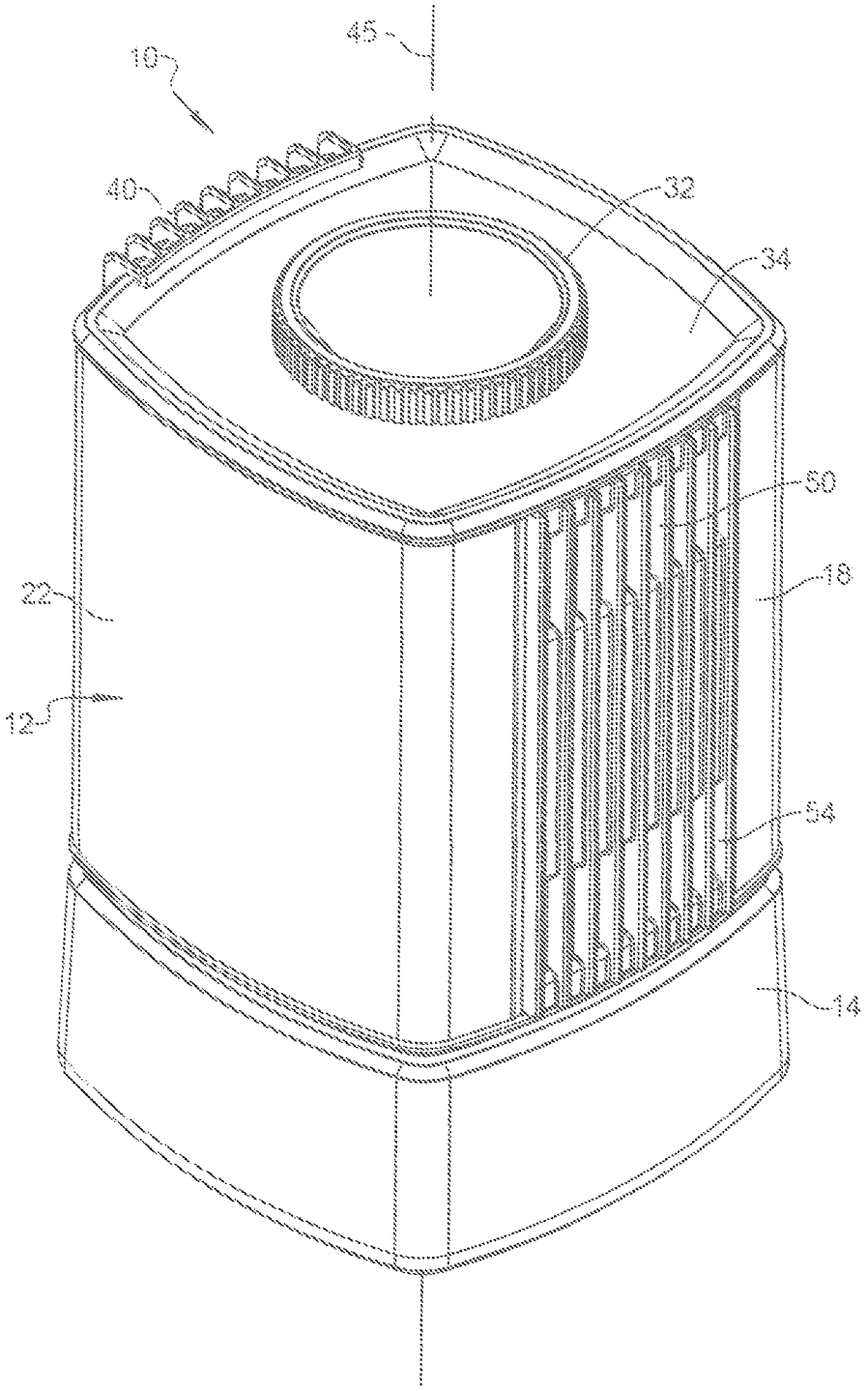
FIG. 2 is a rear right side perspective view of the apparatus of FIG. 1.

As shown in FIGS. 2 and 3*b*, the back portion 18 of the outer housing 12 includes an upper air intake opening 50 and a lower air intake opening 54. As further shown in FIG. 3*b*, the drum 46 has been rotated to allow free intake airflow through the air intake openings 50, 54. In this position, the intake airflow can pass directly through aligned complementary openings 78, 80 in top and bottom portions of the drum 46, as described more fully below.

In order to restrict airflow into and through the outer housing 12, the drum 46 can be rotated to block or restrict airflow from directly flowing into the drum 46 through the upper and lower air intake openings 50, 54. Upper and lower solid outer surface portions 51, 53 (FIG. 5) on the front of the drum 46, when rotated 180 degrees from their position shown in FIGS. 4 and 5, may closely confront and overlap the upper and lower air intake openings 50, 54 so as to restrict the upper and lower air intake openings 50, 54.

Figure 5:
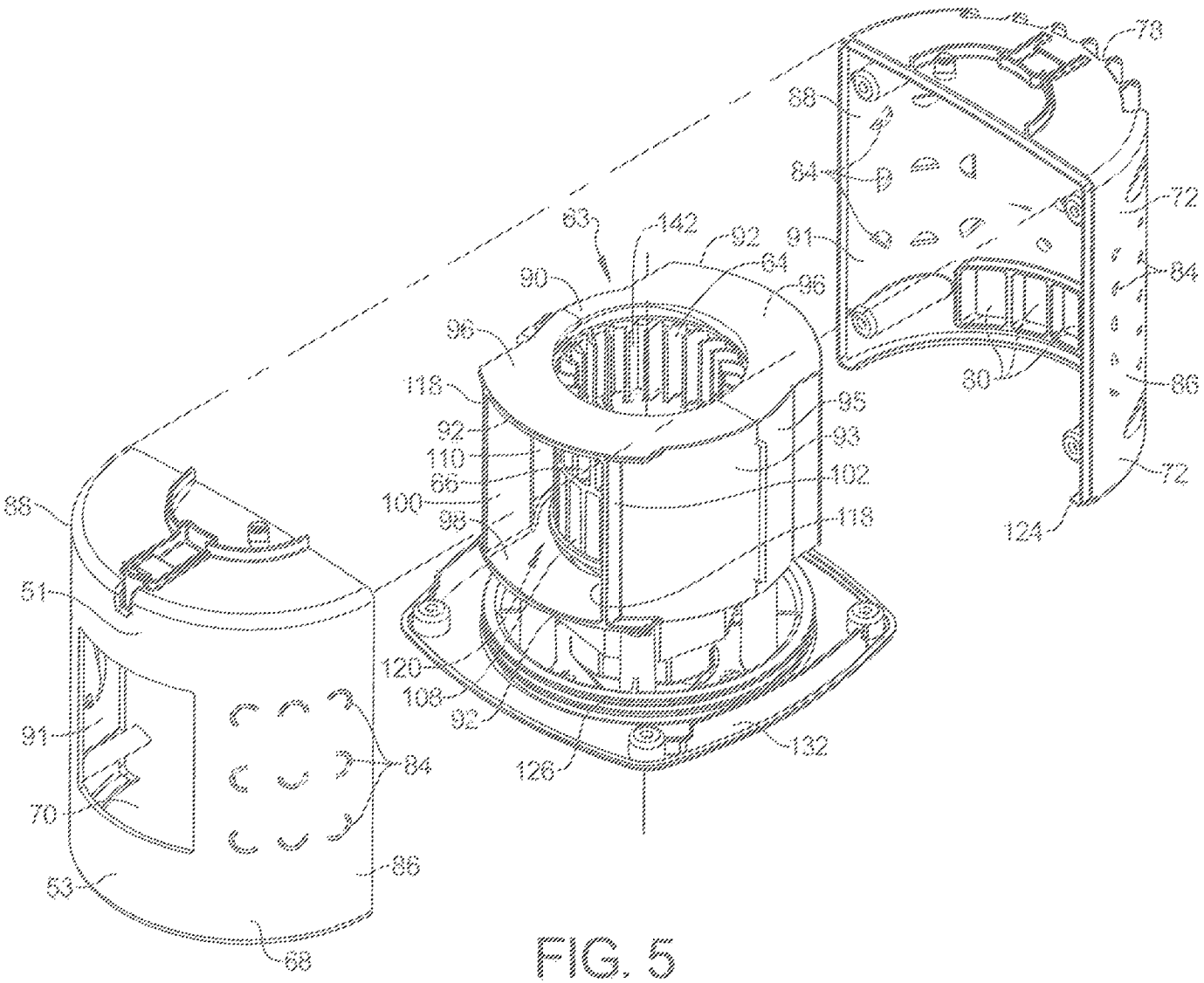
FIG. 5 is a partially exploded top perspective view of a blower fan and drum constructed in accordance with the apparatus of FIG. 1.

The drum 46 is more fully disclosed and its operation more fully understood from the views depicted in FIGS. 5 and 7. In FIG. 5, the outer housing 12 and base 14 have been removed for clarity. The drum 46 is shown constructed with a front drum portion 68 and a rear drum portion 72. The drum 46 is concentrically positioned with a sliding rotating fit over, around and against a blower housing 90.

The blower housing 90 surrounds a motor-driven fan, such as a radial flow centrifugal blower fan 63 having vertically-extending rectangular blades or vanes 64. The vanes 64 are mounted on blower wheel 66 to form a centrifugal impeller in a conventional fashion.

Figure 6:
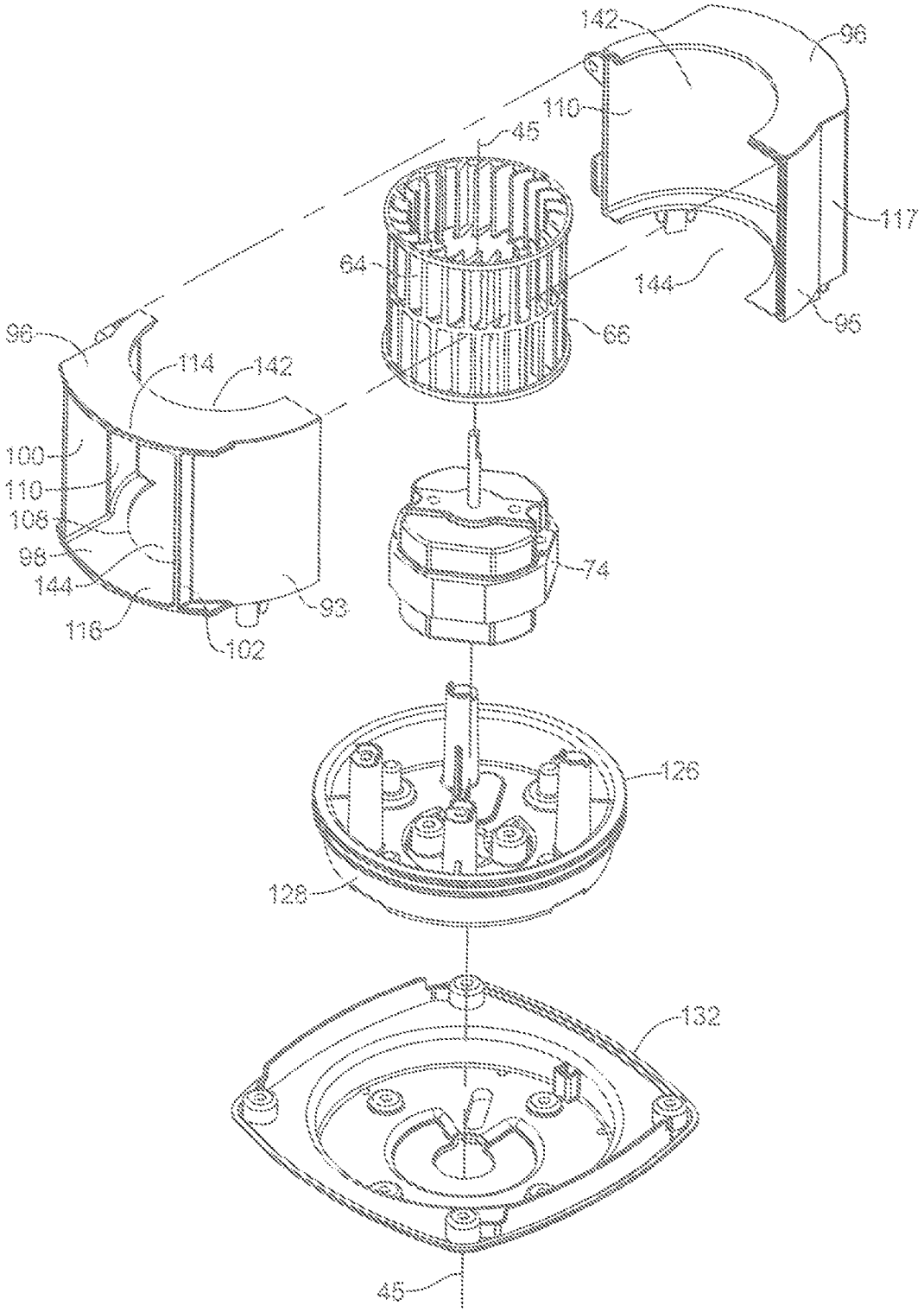
FIG. 6 is an exploded top perspective view of the blower fan shown in FIG. 5.

As further shown in FIG. 5, the front drum portion 68 has a rectangular drum exhaust opening 70 corresponding in size and shape to the front air exit opening 36 in the front housing portion 16. An upper air intake opening 78 (FIG. 7) and a lower air intake opening 80 (FIGS. 5 and 7) are shown formed through the back or rear portion 72 of the drum 46. Visible through the intake opening 80 in FIG. 7 and in the exploded view of FIG. 6 is an electric motor 74 which is connected to and rotates the blower wheel 66.

The upper and lower air intake openings 78, 80 in the drum 46 are about the same size and shape as the upper and lower air intake openings 50, 54 formed through the back portion 18 of the outer housing 12. Although rectangular airflow openings are shown in the figures, other complementary aligned shapes can function in a similar manner.

The upper and lower air intake openings 78, 80 in the drum 46 can be rotated into direct vertical (axial) alignment and circumferential alignment with the respective upper and lower air intake openings 50, 54 on the back portion 18 of the outer housing 12. By varying the degree of alignment between the upper and lower air intake openings 78, 80 on the drum 46 with the upper and lower intake air openings 50, 54 on the outer housing 12, the amount of air directly entering the drum from ambient can be metered as desired to vary the type of noise and airflow produced by the system 10.

As further shown in FIG. 5, various patterns or arrays of holes, slits and/or perforations 84, such as small rectangular, oval, D-shaped or other shaped holes, are formed through the front portion 68 and/or the back portion 72 of the drum 46. The holes 84 in the cylindrical sidewall of the drum 46 can be rotated into multiple user-selected circumferential positions to vary the intensity and noise shape of the broadband noise produced by the fan system 10.

For example, as further shown in FIG. 5, several sets or clusters of smaller circular holes 84 are formed through the right and left cylindrical sidewall portions 86, 88 on the front and rear drum portions 68, 72 to provide variations and selections in noise produced by the system 10. Some of the patterns of holes 84 on the back surface 72 and sidewalls 86, 88 of the drum 46 are arranged in rows and columns. However, many other patterns can be used to vary the broadband noise produced by the system 10.

The relative positions and sliding engagement between the inner cylindrical wall 91 of the drum 46 and the radially outer circular surface portions 92 on upper and lower radially-extending flanges 96 on a fan housing such as blower housing 90 are shown in FIGS. 5 and 7. This rotating sliding engagement or sliding contact forms weak or loose fluid seals 94 (FIG. 7) restricting and directing airflow to various flowpaths as described further below.

As the drum 46 is rotated about forty-five degrees from its position as shown in FIGS. 5 and 7, the drum 46 gradually restricts or blocks the flow of air from freely exiting the front drum opening 70 and directs the flow of air from the blower housing 90 to ambient through one or more of the holes 84 in the drum 46.

FIGS. 5 and 6 show the front and rear portions 93, 95 of the blower housing 90 encircling the blower wheel 66 with the drum 46 and outer housing 12 removed from FIG. 5 and the outer housing 12 removed from FIG. 6 for clarity.

A pair of airflow guide walls 100, 102 extends radially outwardly from the cylindrical sidewall 110 of the blower housing 90. The guide walls 100, 102 also extend vertically between the upper and lower radial flanges 96, 98 on opposite sides of an exhaust port 108 formed in the cylindrical sidewall 110 of the blower housing 90.

In the embodiment shown in FIGS. 1-7, the exhaust port 108 can be the single or sole exhaust port in the blower housing 90. This provides a single strong stream of air blown directly towards the front air exit opening 36 on the outer housing 12.

The airflow guide walls 100, 102 and the portions or segments 114, 116 of the upper and lower radial flanges 96, 98 extending between the guide walls 100, 102 define or form a short exhaust duct 120 (FIG. 7) for guiding airflow from the blower wheel 66 radially outwardly towards the surrounding drum 46. The outer vertical edges 118 of the airflow guide walls 100, 102 are positioned in sliding engagement with the inner cylindrical wall 91 of the drum 46 and cooperate with the circular surface portions 92 on the flanges 96 to maintain the airflow within the exhaust duct 120 and direct the airflow through selected portions of the drum 46.

The circular surface portions 92 and outer vertical edges 118 (FIG. 5) on the blower housing 90 define a rectangular sealing surface against which the rotatable inner cylindrical wall 91 of the drum 46 loosely rubs and slides during rotation of the drum 46. This loose rotational contact forms a loose or weak sliding airflow seal.

The dimensions of this rectangular sealing surface are about the same or slightly larger than the dimensions of the rectangular drum opening 70 for efficiently guiding airflow from the blower wheel 66 radially outwardly through the drum opening 70 and/or through the holes 84 in the drum 46.

As shown in FIGS. 6 and 7, upper and lower radial flanges 96, 98 on the rear portion 95 of the blower housing 90 cooperate with vertical baffle walls 117 to form a rectangular sliding sealing surface similar to that formed on the front portion 93 of the blower housing 90 as described above. However, this sealing surface extends radially from and around a solid portion of the cylindrical sidewall 110 of the blower housing 90 so that airflow from ambient enters the blower housing only through circular openings 142, 144 in the top and bottom of the blower housing and exits the blower housing through the exhaust duct 120.

In FIG. 7, the upper and lower annular flanges 96, 98 are shown in rotational rubbing or sliding contact with the inner cylindrical wall 91 of the drum 46. The concentric mounting of the drum 46 around the blower housing 90 is further shown in FIG. 7.

FIGS. 3*a* and 7 show the exhaust port 108 and the exhaust duct 120 of the blower housing 90 aligned directly towards and confronting the front air exit opening 36 on the outer housing 12. This alignment provides for the substantially unrestricted flow of air through the exhaust duct 120 and out to ambient surroundings when the drum opening 70 is circumferentially aligned and centered between the exhaust duct 120 and the front air exit opening 36. FIGS. 3*a* and 7 further show the location of the drum 46 interposed between the blower housing 90 and the outer housing 12 for free airflow to ambient.

The shapes and sizes of the openings of the exhaust port 108, the exhaust duct 120 and the drum opening 70, aligned as shown in FIG. 7 between the blower housing 90 and the outer housing 12, form an unobstructed radial flowpath which minimizes turbulent airflow when the system 10 is configured to produce mostly a cooling flow of air to ambient. In contrast, when the system 10 is positioned to produce broadband noise, such as when the drum 46 is rotated up to 180 degrees in either direction from its position shown in FIGS. 3*a* and 7, turbulent air is produced through the holes 84 to generate selected sounds and levels of noise.

Again, when used primarily as a cooling fan, the exhaust port 108 and exhaust duct 120 on the blower housing 90 are aligned axially, radially and circumferentially as shown in FIGS. 3*a* and 7 with both the drum opening 70 and the front air exit opening 36 to allow for substantially unrestricted airflow into the ambient surroundings through both the drum 46 and outer housing 12.

In one embodiment, the blower housing 90 and exhaust duct 120 are permanently fixed in axial and circumferential juxtaposed alignment with the front air exit opening 36 on the outer housing 12. The drum 46 is rotationally mounted between the blower housing 90 and the outer housing 12 as further shown in FIG. 7.

As noted above, the drum 46 rotates between the exhaust port 108 on the blower housing 90 and the front air exit opening 36. In the position of the drum 46 shown in FIG. 7, a substantially unrestricted flowpath depicted by flowpath arrows 122 is formed between the blower housing 90 and ambient. As the drum 46 rotates away from this unrestricted position, airflow to ambient becomes more and more restricted until the exhaust duct 120 on the blower housing 90 is closed by the drum 46.

As the opening 70 of the drum 46 rotates away from registration with the radially outer edges of the exhaust duct 120 from an unrestricted open position to a gradually restricted position, the airflow exiting the exhaust duct 120 is split between flowing through opening 70 and holes 84 to ambient through the front air exit opening 36 thereby providing a combination of free and restricted air flow. As drum 46 is rotated further, the airflow to ambient through the front air exit opening 36 passes through holes 84 absent passing through opening 70 providing for a fully restricted air flow.

The combination of unrestricted air flow and restricted air flow generates various amounts of desirable noise and allows a user to select a preferred type of noise at a selected drum position. As the opening 70 in the drum 46 rotates past the exhaust duct 120, an airflow into the interior of the outer housing 12 may be generated which begins to pleasantly resonate providing additional noise characteristics.

FIGS. 5, 6 and 7 further show a circular tongue and groove rotating connection between a radial tongue 124 on the bottom of the drum 46 and a grooved circular ring 126 provided on a fan adaptor plate 128. The fan adaptor plate 128 is mounted on top of a base plate 132 which is mounted on top of the base 14.

A rotating and/or oscillating connection can be provided between the base 14 and the base plate 132 in the form of upper and lower oscillation bearings 134, 136 (FIG. 4). The oscillation bearings 134, 136 nest within an annular pocket 135 formed in the base 14.

In the case of an oscillating connection, an oscillation offset arm 137 is driven by an oscillation motor 138 mounted on the underside of the base 14. Offset arm 137 engages a slot in plate 132, thereby oscillating plate 132 relative to base when offset arm 137 is rotated by motor 138. The oscillating connection allows the outer housing 12, the drum 46, the blower housing 90 and the fan 63 to rotate or pivot and oscillate as a unit on the top of the base 14. Feet 140 under the bottom 139 of the base 14 secure and support the entire system 10.

FIGS. 6 and 7 show a first air inlet in the form of a circular opening 142 in the top of the blower housing 90 through which intake air is drawn by the rotating vanes 64 on the blower wheel 66. Intake air is also drawn through a second air inlet in the form of a circular opening 144 (FIGS. 5, 6 and 7) in the bottom of the blower housing 90.

Depending on the selected position of the drum 46, various flowpaths can be defined through the outer housing 12. As shown in FIG. 7 by flowpath arrows 122, ambient air is drawn into the outer housing 12 through the ambient air inlets 50, 54. The air is then drawn through the air intake openings 78, 80 in the drum 46 and through chamber 150 (described below) and into the first and second air inlets 142,144 in the fan housing 90.

The air is then blown radially outwardly by the fan 63 through the fan exhaust port 108 and exhaust duct 120. At this point, the air can exhaust directly to ambient through the drum exhaust opening 70 and front air exit opening 36 in the outer housing 12.

However, as described above, the drum 46 can be rotated so that air exiting the fan exhaust duct 120 can exit the outer housing 12 through a combination of flowpaths defined partially through the drum exhaust opening 70 and partially through the holes 84, or only through the holes 84. In one mode of operation, little to no air is exhausted from the outer housing 12 as ambient air is blocked from entering the housing 12 as air is swirled around within a chamber 150 (described below) with little to no air exiting the outer housing 12.

As further shown in FIG. 7, a resonating airflow chamber 150 is defined by the interior of the blower housing 90, the spaces between the top of the blower housing 90 and the top portion 34 or roof of the outer housing 12 as well as between the bottom of the scroll housing 90 and the top portion of the base 14. When the drum 46 is rotated to restrict airflow through the front air exit opening 36 by restricting airflow from the exhaust duct 120, swirling airflow may be produced within the chamber 150 which begins to resonate.

This swirling airflow within the chamber 150 produces a desirable noise which is amplified within the chamber 150. As the drum 46 is rotated by a user, the noise shape and intensity of the noise generated within the chamber 150 is adjusted to a point where it suits a user's purpose and liking.

Figure 8A:
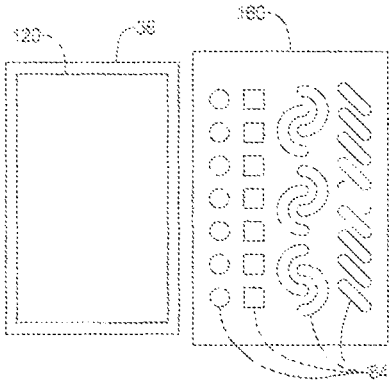
FIGS. 8*a* and 8*b* illustrate an alternative embodiment of an air flow adjustment mechanism.
Figure 8B:
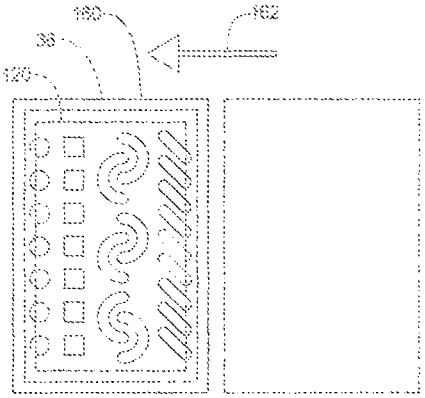

FIGS. 8*a* and 8*b* illustrate an alternative embodiment of an air flow adjustment mechanism to produce desired flow and noise characteristics. A movable wall 160 includes holes 84 that can be of multiple shapes, sizes and patterns. Movable wall 160 is located proximate exhaust duct 120 and air exit opening 36 and is movable relative to exhaust duct 120 and air exit opening 36.

As shown, the movable wall 160 is slidable along direction 162 and can partially or fully cover exhaust duct 120 and air exit opening 36. As such, multiple air flow configurations are possible having a similar effect and functionality of movable drum 46. Although direction 162 is shown as horizontal the invention is not so limited, it is contemplated that direction 162 could be vertical or a rotational movement.

Other variations are within the spirit of the present disclosure. Thus, while the invention is susceptible to various modifications and alternative constructions, certain embodiments thereof have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A cooling fan and noise generating apparatus, comprising:

an outer housing having an air inlet opening and an air exit opening;

an electric fan disposed within said outer housing;

a fan housing disposed around said electric fan and having a fan air inlet and a fan exhaust port; and a movable drum disposed between said outer housing and said fan housing, said movable drum having an air intake opening, an air exhaust opening, and a plurality of noise modifying holes formed through said movable drum;

wherein said fan exhaust port is aligned with said air exit opening to direct airflow from said electric fan towards and through said air exit opening.

2. The apparatus of claim 1, wherein said outer housing and said fan housing are fixed in position relative to each other and said movable drum is rotatable relative to said outer housing and said fan housing.

3. The apparatus of claim 1, further comprising a base, wherein said outer housing, said fan housing, and said movable drum are rotatably mounted on said base via a rotating and/or oscillating connection.

4. The apparatus of claim 1, further comprising an airflow seal provided between said movable drum and said fan housing.

5. The apparatus of claim 1, further comprising an exhaust duct extending between said fan housing and said movable drum.

6. The apparatus of claim 1, wherein said electric fan comprises a centrifugal blower fan, the centrifugal blower fan comprising vertically-extending vanes mounted on a blower wheel.

7. The apparatus of claim 1, wherein said fan exhaust port is the sole exhaust port in said fan housing.

8. The apparatus of claim 1, wherein said movable drum forms a chamber around said fan housing.

9. The apparatus of claim 1, further comprising a rotatable knob provided on said outer housing and connected to said movable drum for rotating said movable drum within said outer housing.

10. The apparatus of claiml, wherein said movable drum comprises a solid surface portion movable to a position adjacent to and confronting said air inlet opening to restrict ambient airflow into said outer housing.

11. The apparatus of claim 1, further comprising a plurality of air flowpaths having selectable restrictions to airflow, said air flowpaths configured to direct air into and through said outer housing, wherein said electric fan draws air into said outer housing through said air inlet opening in said outer housing, through said air intake opening in said movable drum, and into said fan air inlet in said fan housing, and wherein said electric fan blows air from within said fan housing through said fan exhaust port into and through either one or both of said air exhaust opening in said movable drum and at least one of said noise modifying holes in said movable drum, and then towards said outer housing.

12. A cooling fan and noise generating apparatus, comprising:

a base;

an electric fan supported on said base;

an outer housing supported on said base and having a front housing portion formed with a front air exit opening and a back housing portion formed with an air intake opening;

a rotatable drum supported on said base and mounted within said outer housing and having a rear drum air intake, a front drum exhaust opening, a solid surface portion, and a plurality of holes formed through said rotatable drum; and a fan housing provided within said rotatable drum, said fan housing having a fan air inlet and a fan air exhaust port;

wherein said rotatable drum is rotatable into a first position with said solid surface portion confronting and restricting air from flowing through said air intake opening in said back housing portion, and rotatable into a second position with said front drum exhaust opening confronting said fan air exhaust port and allowing air to flow directly from said fan housing without restriction from said rotatable drum.

13. The apparatus of claim 12, wherein said rotatable drum is rotatable into a third position with at least some of said plurality of holes in said rotatable drum confronting said fan air exhaust port for modifying noise.

14. The apparatus of claim 12, wherein said solid surface portion is located adjacent to said front drum exhaust opening.

15. The apparatus of claim 12, further comprising an air duct extending between said fan air exhaust port and said rotatable drum, said air duct configured to direct airflow from said electric fan towards said front air exit opening in said front housing portion.

16. The apparatus of claim 15, wherein said rotatable drum is configured to rotate around and slide against said air duct.

17. The apparatus of claim 16, wherein sliding contact between said rotatable drum and said air duct forms a seal restricting airflow into said rotatable drum.

18. A cooling fan and noise generating apparatus comprising:

an outer housing having an air exit opening and an air inlet opening;

a movable drum disposed within said outer housing, said movable drum comprising:

a drum wall defining an interior space;

at least one air intake opening in said drum wall;

a front drum exhaust opening in said drum wall; and a plurality of holes in said drum wall; and a fan assembly at least partially located in said interior space, said fan assembly comprising:

a fan housing wall;

at least one air inlet in said fan housing wall;

only one air exhaust port in said fan housing wall;

a centrifugal impeller located within said fan housing wall; and a motor connected to and configured to rotate said centrifugal impeller;

wherein an airflow is generated by a rotation of said centrifugal impeller, said airflow is drawn into said at least one air intake opening in said drum wall, subsequently enters said at least one air inlet in said fan housing wall, subsequently exits through said only one air exhaust port in said fan housing wall, and subsequently passes through said drum wall via said front drum exhaust opening and/or at least one of said plurality of holes in said drum wall; and wherein multiple air delivery configurations are possible depending on a position of said movable drum relative to said only one air exhaust port in said fan housing wall.

19. The cooling fan and noise generating apparatus of claim 18, further comprising a first of said multiple air delivery configurations, wherein the position of said movable drum substantially aligns said front drum exhaust opening in said drum wall with said only one air exhaust port in said fan housing wall.

20. The cooling fan and noise generating apparatus of claim 19, further comprising a second of said multiple air delivery configurations, wherein the position of said movable drum substantially aligns said plurality of holes in said drum wall with said only one air exhaust port in said fan housing wall, and wherein no portion of said front drum exhaust opening in said drum wall is in alignment with said only one air exhaust port in said fan housing wall.

21. The cooling fan and noise generating apparatus of claim 20, further comprising a third of said multiple air delivery configurations, wherein the position of said movable drum aligns at least one of said plurality of holes in said drum wall and at least a portion of said front drum exhaust opening in said drum wall with said only one air exhaust port in said fan housing wall, and wherein said airflow passes through said front drum exhaust opening and passes through at least one of said plurality of holes.

22. A cooling fan and noise generating apparatus comprising:

an outer housing having an air exit opening and an air inlet opening;

a fan assembly disposed within said outer housing, the fan assembly comprising:

a fan housing wall;

at least one air inlet in said fan housing wall;

an air exhaust port in said fan housing wall;

an exhaust duct extending from said air exhaust port in said fan housing wall;

a centrifugal impeller located within said fan housing wall; and a motor connected to and configured to rotate said centrifugal impeller; and a movable wall disposed between said outer housing and said fan housing wall, the movable wall comprising:

a surface;

a plurality of holes in said surface;

wherein an airflow is generated by a rotation of said centrifugal impeller, said airflow is drawn into said at least one air inlet in said fan housing wall, and subsequently exits through said air exhaust port in said fan housing wall;

wherein said movable wall moves relative to said exhaust duct and can be positioned to completely cover, partially cover, or not cover said air exhaust duct; and wherein multiple air delivery configurations are possible depending on a position of said movable wall relative to said exhaust duct, for changing a noise characteristic produced by said cooling fan and noise generating apparatus.

23. The cooling fan and noise generating apparatus of claim 22, wherein said movable wall moves in a sliding fashion relative to said exhaust duct.

* * * * *